United States Patent [19]

Whiteley

[11] 4,074,681

[45] Feb. 21, 1978

[54] FORCED AIR CIRCULATION HEATING UNIT FOR FIREPLACES

[75] Inventor: Isaac C. Whiteley, Redmond, Oreg.

[73] Assignee: W-A Red Hot, Inc., Redmond, Oreg.

[21] Appl. No.: 545,402

[22] Filed: Jan. 30, 1975

[51] Int. Cl.[2] ..... F23H 13/00

[52] U.S. Cl. ..... 126/164; 126/121; 126/163 R

[58] Field of Search ..... 126/121, 128, 129, 131, 126/143, 163 R, 163 A, 164, 165; 237/51

[56] References Cited

U.S. PATENT DOCUMENTS

| | | | |
|---|---|---|---|
| 2,231,258 | 2/1941 | Elmore | 126/121 X |
| 2,258,882 | 10/1941 | Craig | 126/121 |
| 2,828,078 | 3/1958 | Snodgrass | 126/121 X |
| 3,269,383 | 8/1966 | Maasberg | 126/164 |
| 3,866,595 | 2/1975 | Jones | 126/121 |
| 3,930,490 | 1/1976 | Lassey et al. | 126/121 |

FOREIGN PATENT DOCUMENTS

| | | | |
|---|---|---|---|
| 330,745 | 11/1933 | Italy | 126/143 |
| 74,395 | 12/1948 | Norway | 126/121 |
| 1,169,587 | 11/1969 | United Kingdom | 126/121 |
| 622,417 | 5/1949 | United Kingdom | 126/121 |
| 1,008,428 | 10/1965 | United Kingdom | 126/121 |

*Primary Examiner*—Ronald C. Capossela
*Attorney, Agent, or Firm*—Robert H. Epstein

[57] ABSTRACT

A forced air circulation heating unit is formed of a U-shaped conduit placed on the floor of the fireplace and a fan forcing air through the conduit to be heated in the fireplace and projected into the room. Jets are provided on the conduit to direct streams of air from legs of the conduit toward a base joining the legs in order to completely burn fuel thereby reducing carbon monoxide, to facilitate starting of a fire and to reduce smoking. The base of the conduit has an increased cross-sectional flow of air and the jet streams cooperate with the base to assure that the hottest part of the fire is produced by coals on and adjacent the base thereby increasing heat obtained from the unit and saving fuel.

6 Claims, 3 Drawing Figures

FORCED AIR CIRCULATION HEATING UNIT FOR FIREPLACES

BACKGROUND OF THE INVENTION

1. Field of the invention

The present invention pertains to fireplace heating and, more particularly, to a forced air circulation heating unit for installation in a fireplace to increase heat obtained therefrom.

2. Discussion of the prior art

Fireplaces are used a great deal for heating and for the pleasant ambiance produced thereby; however, fireplaces are notorious for the wasted heat and fuel associated therewith in that not only does a great amount of heat created by the burning of fuel, such as wood, coal and the like, escape through the fireplace chimney but heat from the remainder of the house or building housing the fireplace is also exhausted through the fireplace chimney.

There have been attempts in the prior art to provide apparatus for increasing the efficiency of fireplace heating by drawing or forcing air through the fireplace to heat the air and return the heated air to the room, as exemplified by U. S. Pat. No. 2,642,859 to Brown. Such prior art apparatus, however, have suffered the disadvantages of being relatively bulky, expensive and difficult to install; and, further, such apparatus have invariably drawn air into the fireplace under a support for the burning fuel and forced the heated air out of the fireplace at a location vertically spaced from the indrawn air near the top of the fireplace. The circulation provided by such apparatus is limited, and the burning coals and ashes have tended to be massed at the rear of the apparatus tending to burn out the apparatus.

U.S. Pat. No. 2,828,078 to Snodgrass, No. 3,001,521 to Reilly and No. 3,240,206 are exemplary of prior art apparatus for supplying heated air from a fireplace by means of conduits forming parts of grates or incorporating baffles and adapted to have air blown therethrough. While these apparatus provide increased circulation of hot air, they are not as efficient in preserving fuel and obtaining maximum heat from fuel as is desirable.

SUMMARY OF THE INVENTION

Accordingly, it is a primary object of the present invention to provide a forced air circulation heating unit for fireplaces overcoming the above mentioned disadvantages of the prior art.

Another object of the present invention is to increase circulation of air heated in a fireplace by exhausting the heated air at the same level at which cool air is drawn into the fireplace.

A further object of the present invention is to provide a forced air circulation heating unit for fireplaces that is integrally formed so as to be easily transported and installed, the installation requiring only the placing of a conduit on the floor of a fireplace and the connecting of a fan thereto.

The present invention has yet another object in that a U-shaped conduit is placed on the floor of a fireplace to be positioned amidst the hot coals of burning fuel such that air forced through the conduit is heated and diffused through the room.

Additionally, it is a basic object of the present invention to enhance the burning of fuel in a fireplace by directing a stream of air at the burning coals thereby assuring complete burning of the coals to minimize the creation of carbon monoxide, facilitate starting of a fire and reduce smoking of the fuel.

Yet, another object of the present invention is to construct a U-shaped conduit for heating air in a fireplace with a base having a larger cross-sectional flow area than the cross-sectional flow area of inlet and outlet legs joining the base to provide a chamber of increased size and, further, to direct at least one stream of air at the base chamber to assure that the coals adjacent the base chamber completely burn at their hottest and thereby increase the heat withdrawn from the fireplace and the efficiency thereof.

Some of the advantages of the present invention over the prior art are that the forced air circulation heating unit of the present invention assures complete burning of fuel, is inexpensive to produce, is simple to install requiring no mounting hardware, is small in size to facilitate transportation and handling, provides increased circulation by drawing cold air and expelling heated air at the same level close to the floor and is extremely efficient in fuel burning and heat withdrawn.

The present invention is generally characterized in a forced air circulation heating unit for installation in a fireplace including a generally U-shaped conduit having an inlet and an outlet and adapted to be positioned on the floor of the fireplace with the inlet and outlet disposed on opposite sides of the fireplace, a fan for blowing air through the conduit from the inlet to the outlet such that air forced through the conduit is heated by fuel burned in the fireplace to supply a flow of hot air from the outlet of the conduit, a jet extending from the conduit for supplying an inwardly directed stream of air toward the fuel whereby starting of a fire in the fireplace is aided, smoking of the fuel is reduced and the fuel is completely burned.

Other objects and advantages of the present invention will become apparent from the following description of the preferred embodiment taken in conjunction with the accompanying drawings.

DESCRIPTION OF THE PREFERRED EMBODIMENT

Figure 1:
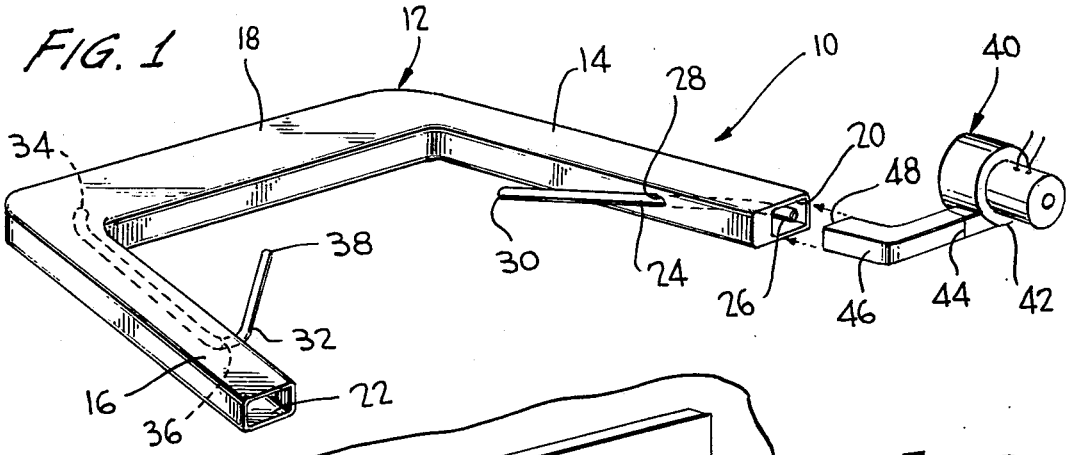
FIG. 1 is an exploded perspective of a forced air circulation heating unit for fireplaces according to the present invention.

A forced air circulation heating unit 10 according to the present invention is illustrated in FIG. 1 and includes a pipe or conduit 12 having a generally U-shaped configuration in plan with an inlet leg 14, an outlet leg 16 and a base 18 interconnecting the inlet and outlet legs. The inlet leg 14 has an inlet opening 20 in an end thereof smaller than the cross-sectional size of the inlet leg and the outlet leg 16 is open at its end to define an outlet opening 22.

The inlet and outlet leg portions are rectangular in cross-section and may, for example, be formed of a two inch by three inch pipe while the base of the conduit 12 preferably has dimensions greater than those of the inlet and outlet legs, for example having a rectangular configuration and being made of a two inch by five inch pipe such that the cross-sectional flow area in the base is greater than the cross-sectional flow area in the inlet and outlet legs. The conduit 12 can be formed in any suitable manner such as with sheet steel or cast iron to provide the desired configuration and relative sizes of the legs and base; however, it is preferred that the wall thickness of the base 18 be greater than that of the inlet and outlet legs to be able to withstand the intense heat to which the base is exposed. Within the conduit 12 are positioned a small tube 24 having one end 26 thereof positioned adjacent the inlet opening 20, the tube extending through a hole 28 in a side wall of leg 14 to an end 30 positioned within the U-configuration of the conduit 12 at an angle relative to the base 18 to direct a stream of air at the side wall of the base. A second small tube 32 is mounted in the leg 16 and has an end 34 disposed at the corner where leg 16 joins base 18, the tube 32 extending through a hole 36 in a side wall of leg 16 to an end 38 within the U-configuration of the conduit 12 at an angle relative to base 18 for directing a stream of air at the side wall of base 18 from a direction opposite to that of tubing 24. The tubes 24 and 32 form inwardly directly jets to deliver converging fresh air streams to the fuel and can be simply made from copper tubing one-half inch in diameter, for example.

A blower unit 40 includes an electrically driven fan 42 having an outlet 44 connected with a steel tubing or pipe elbow 46, and the elbow 46 has an end 48 adapted to be removably received in the inlet opening 20 of the conduit 12 and an end removably coupled with the fan outlet 44. Any suitable fan 42 can be utilized with the present invention; however, it is desired that such fan be small in size and preferably have an output in the range of 50 to 70 cubic feet per minute, preferably 60 cubic feet per minute.

Figure 2:
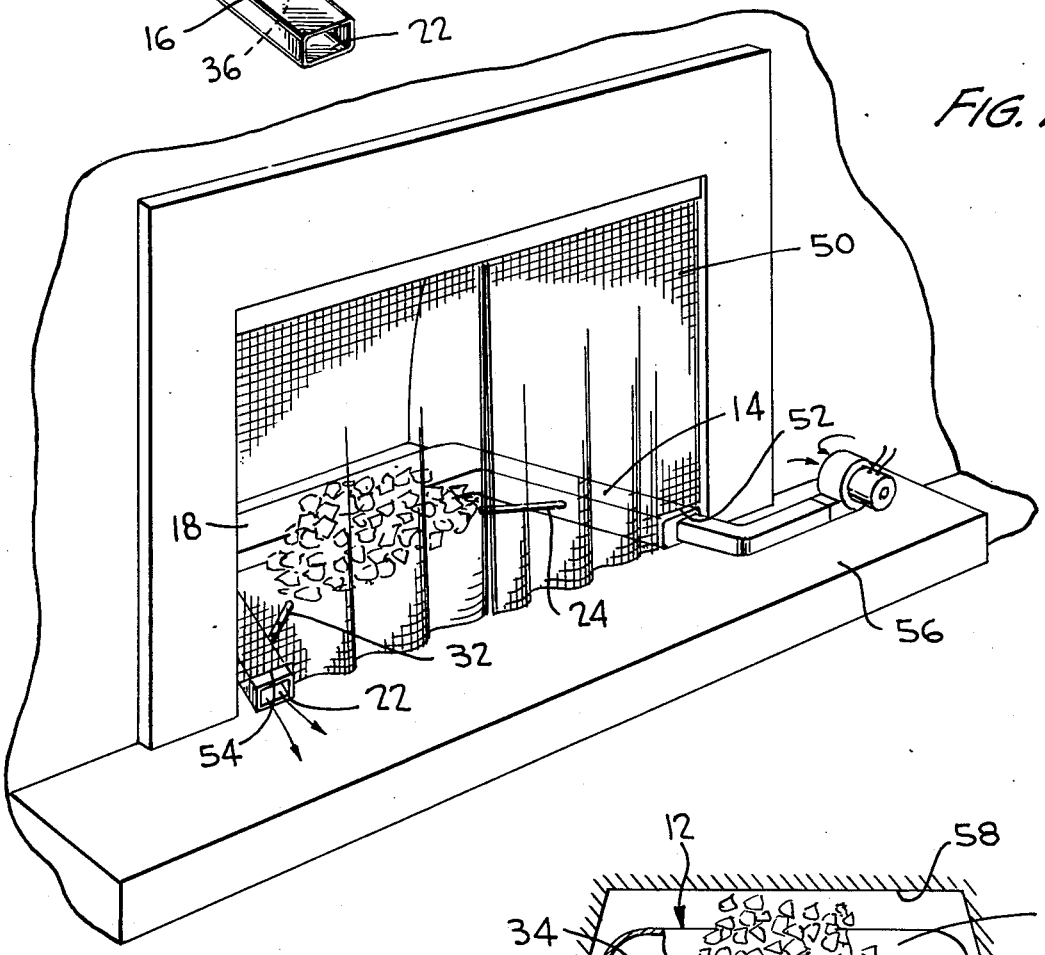
FIG. 2 is a perspective of the forced air circulation heating unit of FIG. 1 installed in a fireplace.
Figure 3:
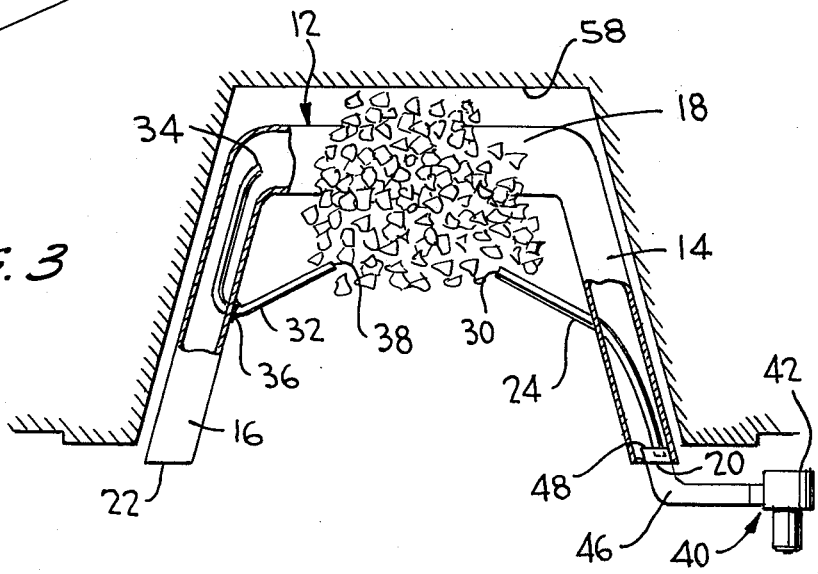
FIG. 3 is a top plan view of the forced air circulation heating unit of FIG. 1 installed in a fireplace.

The forced air circulation unit 10 of FIG. 1 is illustrated in FIGS. 2 and 3 installed in a fireplace, it being noted that the pipe 12 merely rests on the floor of the fireplace with the inlet 20 and outlet 22 approximately flush with the face of the fireplace on opposite sides thereof. The conduit 12 can be positioned in the fireplace with the outlet on either side of the fireplace in order to permit hot air circulation to be directed as desired. To this end, the elbow 46 connecting the fan 42 with the conduit 12 can be removed from the pump to permit the fan to be disposed on either side of the fireplace and connected by the reversed elbow 46 with the inlet 20. From FIG. 2, it can be seen that the fireplace can be provided with a metal screen or other suitable device to prevent cinders from entering the room without interference from the forced air circulation heating unit 10, the screen 50 having cutouts 52 and 54 at the bottom edges on opposite sides thereof to accommodate the inlet 20 and outlet 22 of the conduit 12. The fan 42 rests directly on the hearth 56 to the side of the fireplace.

Installation of the forced air circulation heating unit 10 is extremely simple and only requires the placement of conduit 12 in the fireplace with the inlet and outlet on the desired sides of the fireplace and the connection of the elbow 46 with the fan 42 and the inlet 20 of the conduit. The fan can be plugged into any available electrical outlet, and a switch or other control, such as a baffle, can be provided to selectively operate the fan. The integral structure of the conduit 12 permits easy handling for transportation and installation and facilitate removal for replacement or repair.

As best shown in FIG. 3, the base 18 of the conduit does not extend to the rear firewall 58 of the fireplace but rather is spaced therefrom preferably by a distance of from four to six inches; and, similarly, the inlet and outlet legs of the conduit need not be disposed in abutting relation with the side firewalls of the fireplace. Thus, it will be appreciated that precise positioning of the conduit 10 in the fireplace is not required due to the cooperation of the streams of air from tubes 24 and 32 with the chamber formed by base 18 which assures that the coals on and adjacent the base are red hot.

In operation, fuel to be burned, such as coal, wood or the like, is placed in the fireplace with at least a portion of the fuel positioned on the base 18 of the conduit 12. The forced air from fan 42, as well as passing through the conduit 12 to exit at outlet 22, will flow from tubes 24 and 32 to produce small jets or streams of air directed at the side of the base 18 of the conduit. The air flowing through the conduit 12 will be heated by the burning fuel such that a flow of heated air will be projected from outlet 22 within a range of from 50 to 70 cubic feet per minute, preferably 60 cubic feet per minute. With a moderate fire, the effluent from outlet 22 will have a temperature of approximately 250° F., and the wide opening of the outlet 22 will permit the hot flowing air to diffuse throughout the room. The positioning of the fan 42 and the outlet 22 of the conduit 12 at substantially the same level permits air to be circulated throughout a room or area in an extremely efficient manner at a low level and provides excellent circulation throughout the area without requiring additional pipes or conduits for distributing the heated air. The forced air circulation heating unit 10 of the present invention thus creates a circulating system by drawing cold air from the floor level and returning heated air to the same level to replace the withdrawn cold air.

The jets of air from tubings 24 and 32 supply air and oxygen to the underside of the fuel laid on top of and adjacent the base 18 of the conduit thereby assuring that the fuel is completely burned and does not lay and smolder thereby minimizing the creation of carbon monoxide gas. Furthermore, the jets of air are directed under the fuel to maintain live coals and reduce the flames required to produce a given amount of heat. Thus, the forced air circulation heating unit 10 provides fuel saving economy by completely burning fuel and assuring that the coals adjacent the increased chamber formed in base 18 are maintained live and red hot. Other advantages provided by the streams of air from tubes 24 and 32 are that the fresh air and oxygen aid the starting of a fire in the fireplace and create a small flow of air rising up the chimney to reduce smoking.

The conduit 12 could have any desired cross-sectional configuration; however, a rectangular cross-sectional configuration is preferred due to its providing a long flat surface for support on the fireplace floor and for supporting fuel. Furthermore, the side walls of the conduit define a confined space into which the streams of air from tubes 24 and 32 can be inwardly directed to assure that the air streams contact all of the fuel.

Inasmuch as the present invention is subject to many variations, modifications and changes in detail, it is intended that all subject matter described above or shown in the accompanying drawings be interpreted as illustrative and not in a limiting sense.

What is claimed is:

1. A forced air circulation heating unit for installation in a fireplace comprising a generally U-shaped conduit formed of an inlet leg having an end defining an inlet for said conduit, and outlet leg having an end defining an outlet for said conduit, and a base joining said inlet and outlet legs, said conduit being adapted to be positioned on the floor of the fireplace with said inlet and outlet disposed on opposite sides of the fireplace; fan means for blowing air through said conduit from said inlet to said outlet such that air forced through said conduit is heated by fuel burned in the fireplace to supply a flow of hot air from said outlet of said conduit; and jet means including a first tube extending from said inlet leg for directing a first stream of air along said inlet leg at said conduit base and a second tube extending from said outlet leg for directing a second stream of air along said outlet leg at said conduit base, said first and second streams of air converging toward one another to provide air along said conduit base to maintain fuel on said conduit live whereby starting of a fire in the fireplace is aided, smoking of the fuel is reduced and the fuel is completely burned.

2. A forced air circulation heating unit as recited in claim 1 wherein said first tube extends through a side wall of said inlet leg to an end disposed within the U-shaped configuration of said conduit and said second tube extends through a side wall of said outlet leg to an end disposed within the U-shaped configuration of said conduit.

3. A forced air circulation heating unit as recited in claim 2 wherein said base of said conduit has a greater cross-sectional flow area than said inlet leg and said outlet leg.

4. A forced air circulation heating unit as recited in claim 3 wherein said conduit has a rectangular configuration in cross section with the longer sides disposed in a horizontal plane.

5. A forced air circulation heating unit as recited in claim 1 wherein said fan means includes an electric fan having an outlet and an elbow pipe having a first end communicating with said fan outlet and a second end communicating with said conduit inlet, said elbow pipe being removable from said fan and said conduit to have said second end communicating with said fan outlet and said first end communicating with said conduit inlet whereby the flow of air through the fireplace can be reversed by moving said fan from one side of the other and reversing the position of said conduit inlet and said conduit outlet in the fireplace.

6. A forced air circulation heating unit as recited in claim 1 wherein said conduit is rectangular in cross-section and the cross-sectional flow area of said base is greater than the cross-sectional flow area of said inlet and outlet legs.

* * * * *